United States Patent [19]

Wilkerson

[11] Patent Number: 4,663,792

[45] Date of Patent: May 12, 1987

[54] APPARATUS FOR TREATING THE MARGINAL EDGE PORTION OF A SHOE SOLE

[76] Inventor: James W. Wilkerson, Rt. 3, Box 165, Savannah, Tenn. 38372

[21] Appl. No.: 656,948

[22] Filed: Oct. 2, 1984

[51] Int. Cl.[4] ..... A43D 8/34; A43D 8/32; C14B 1/02

[52] U.S. Cl. ..... 12/86.5; 12/86; 12/85; 69/11

[58] Field of Search ..... 12/85, 85.1, 86, 86.5, 12/62, 63, 73.5; 69/9, 11, 12, 13, 6.5

[56] References Cited

U.S. PATENT DOCUMENTS

| | | | |
|---|---|---|---|
| 1,315,367 | 9/1919 | Jacquemin | 12/63 |
| 1,706,485 | 3/1929 | Furber | 12/63 |
| 1,711,588 | 5/1929 | Clarke et al. | 12/63 |
| 1,772,465 | 8/1930 | Peake | 12/63 |
| 1,926,150 | 9/1933 | Johnson | 69/9 |
| 2,141,134 | 12/1938 | Gillis | 12/61 B |
| 2,217,753 | 10/1940 | Johnson | 12/17 A |
| 2,241,478 | 5/1941 | Remington | 12/63 |
| 2,378,940 | 6/1945 | MacKenzie | 69/13 |
| 2,485,708 | 10/1949 | Dame | 69/9 |
| 3,028,613 | 4/1962 | Lane | 69/13 |

*Primary Examiner*—Henry S. Jaudon
*Assistant Examiner*—Steven N. Meyers
*Attorney, Agent, or Firm*—Harrington A. Lackey

[57] ABSTRACT

An apparatus for treating the marginal edge portion of a shoe sole, including a longitudinally reciprocable carriage supporting a template having an opening or cavity of generally the same profile as and smaller than, a sole to be treated, whereby the sole is supported on the template covering the opening. A suction is created within the covered opening to draw the central portion of the sole down into the opening while the marginal edge portion of the sole is supported on the top of the pattern member. The carriage is driven longitudinally beneath a transverse pressure roller at an elevation to cause a transverse knife to engage only the supported marginal edge portion of the sole to split the same, while passing over the depressed central portion of the sole. After the sole has been split, the vacuum is removed to facilitate discharge of the cut sole. The apparatus may also include a transverse primer roller between the pressure roller and the discharge station for applying a primer coating to the cut marginal edge portion of the sole.

13 Claims, 11 Drawing Figures

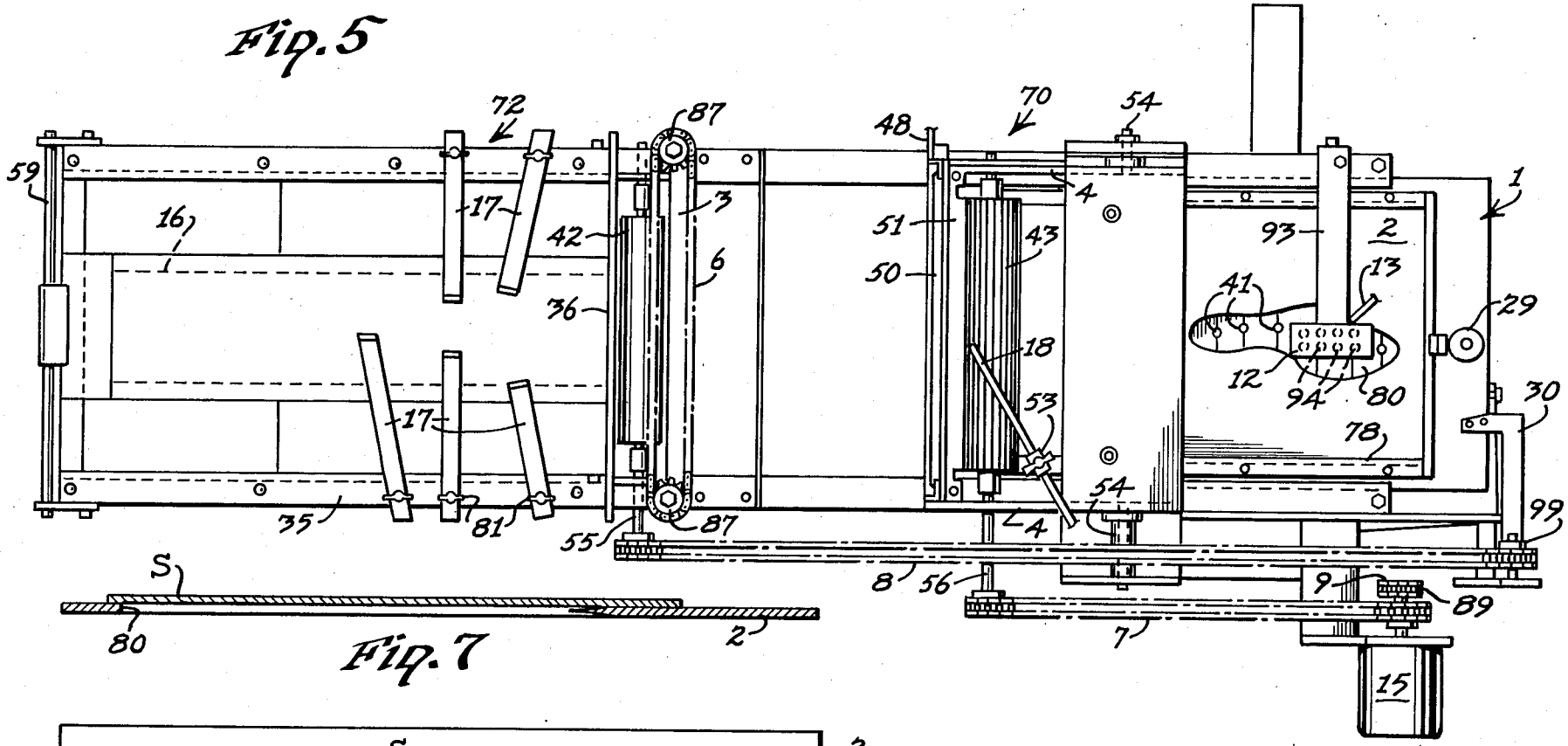
Fig. 5
Fig. 7
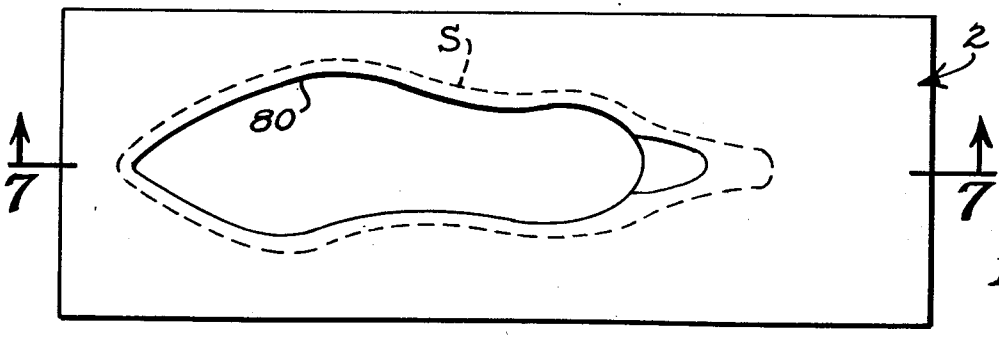
Fig. 6

APPARATUS FOR TREATING THE MARGINAL EDGE PORTION OF A SHOE SOLE

BACKGROUND OF THE INVENTION

This invention relates to an apparatus for treating a shoe sole, and more particularly to an apparatus for splitting the marginal edge portions of a shoe sole.

Heretofore, the marginal edge portion of an outer shoe sole has been split or skived to facilitate securing the marginal edge portion of the outer shoe sole to the inturned marginal edge portions of the shoe upper. The marginal edge portion of the outer shoe sole is cut or skived to reduce its thickness so that the inturned marginal edge portion of the shoe upper may be placed and adhesively secured to the marginal edge portion of the sole. Accordingly, the inner surface of the central portion of the outer sole will be substantially flush with the inner surfaces of the inturned upper marginal edge portions. Thus, when an insole is placed within the shoe, the insole will fit substantially level and smooth on top of the inner surface of the central portion of the outer sole and against the inner surface of the marginal edge portions of the upper. Consequently, there will be no ridges along the margin of the inner sole which will be uncomfortable to the foot of the wearer of the completed shoe.

After the marginal edge portion of the inner or upper surface of the outer shoe sole is cut, split, or skived, the skived portion is primed with an adhesive primer solution. A shoe adhesive is then applied on top of the primed, skived, marginal edge portion for securing to the inturned marginal edge portions of the upper.

The skiving of the marginal edge portions of the shoe sole also tends to roughen the marginal edge portions to provide a better bond for the primer and the adhesive.

Heretofore, the steps of skiving the marginal edge portion of the shoe sole and the priming of the skived edge portion have been performed separately. The priming has been done manually, and the skiving operation has been carried out semi-automatically.

One form of sole splitting apparatus previously used is schematically disclosed in FIG. 11. The prior sole splitting apparatus includes a pair of upper and lower rollers stationarily mounted for rotation opposing each other at a sole splitting station. Behind the rollers and extending between the rollers is a fixed knife having a transverse cutting edge. In advance of the splitting station is a fixed bed plate upon which the shoe sole is placed. A sole pattern, having an external profile or periphery identical to the periphery of the shoe sole, is placed in vertical alignment on top of the shoe sole. The pattern has a central opening having a profile substantially similar to the outer profile of the shoe sole, but smaller in size, to provide a marginal rim in the pattern resting against the rim or marginal portion of the shoe sole. The upper roller is solid steel, while the lower roller has a semi-resilient surface, such as a polyurethane surface. The matched pattern and shoe sole are then fed by hand between the driven rollers until the end of the shoe sole engages the knife. The relative levels of the shoe sole and the knife are such that the knife cuts or skives only the marginal portion of the shoe sole, since the central portion is forced upwardly into the pattern cavity or opening by the urethane surface of the lower roller.

The disadvantage of the prior art apparatus disclosed in FIG. 11 is that after the pattern and shoe have passed through the splitting station, an operator must separate the pattern from the shoe sole, discharge the cut shoe sole, retrieve the pattern and return it by hand to the advance or feed side of the splitting station where the pattern is matched with a subsequent sole in preparation for feeding into the splitting station.

Other examples of machines for skiving or cutting shoe parts, and particularly soles, are disclosed in the following U.S. Pats. Nos.: 467,441, Scott, Jan. 19, 1892; 1,315,367, Jacquemin, Sept. 9, 1919; 1,382,689, Stewart, June 28, 1921; 1,706,485, Furber, Mar. 26, 1929; 2,141,134, .Gillis, Dec. 20, 1938; 2,217,753, Johnson, Oct. 15, 1940; 2,241,478, Remington, May 13, 1941; 2,378,940, MacKenzie, June 26, 1945.

The patents to Scott, Stewart, Gillis and Johnson disclose skiving machines in which a pair of opposed rollers are used to feed the shoe part toward the stationary knife blade, and in which one of the rollers is a matrix roller having a depression formed in the surface of the matrix roller for receiving the portion of the shoe part which is not to be cut.

The patents to Furber and Gillis disclose reciprocating feed slides for feeding a flat shoe part to the skiving or cutting mechanism.

The Remington U.S. Pat. No. 2,241,478 discloses the concept of utilizing a matrix plate having cavities in communication with a suction device for holding down portions of the shoe parts not to be cut. However, Remington utilizes a disc type knife which is moved across the matrix plate for skiving the raised portions of the shoe part.

MacKenzie discloses a sole chamfering machine in which the edges of the sole are chamfered by a knife and the cut edges are coated with a cement. However, it would appear that the sole has to be guided by hand beneath the cutting and cement applying tools.

SUMMARY OF THE INVENTION

It is therefore an object of this invention to provide a sole splitting apparatus in which more of the steps performed in the splitting of the shoe sole are automated.

Another object of this invention is to provide a sole splitting apparatus in which only a single pressure roller is utilized and a reciprocable carriage is provided for continuously supporting a pattern of a given size whereby the shoe sole is deposited on top of the pattern instead of beneath it, and the carriage moves the pattern continuously back and forth through the sole splitting station.

Another object of this invention is to provide a sole splitting apparatus in which each shoe sole may be automatically fed with the pattern from the feed station through the cutting or splitting station, and the sole is automatically removed and discharged from the pattern in the delivery station after the sole has been split.

Another object of this invention is to provide a sole splitting apparatus incorporating a primer applicator for automatically applying a primer solution only to the cut marginal edge of the sole after the sole has been split, and before the sole is discharged.

Another object of this invention is to provide an apparatus for automatically splitting the marginal portions of the shoe soles in less time and with less effort than previous devices for splitting shoe soles.

Another object of this invention is to provide an automatic shoe sole splitting apparatus in which automatic controls may be utilized for creating a vacuum for holding an outer shoe sole, with its central portion depressed, as the sole moves from a feeding station through a cutting station to a delivery station and for reversing the air pressure from negative to positive to eject the shoe sole from the pattern in the delivery station.

BRIEF DESCRIPTION OF THE DRAWINGS

FIG. 5 is a view similar to FIG. 4, in which the carriage is in its protracted or delivery position;

FIG. 6 is an enlarged plan view of the pattern member;

FIG. 7 is a section taken along line 7—7 of FIG. 6 showing the shoe sole supported on the pattern member.

DESCRIPTION OF THE PREFERRED EMBODIMENTS

Figure 1:
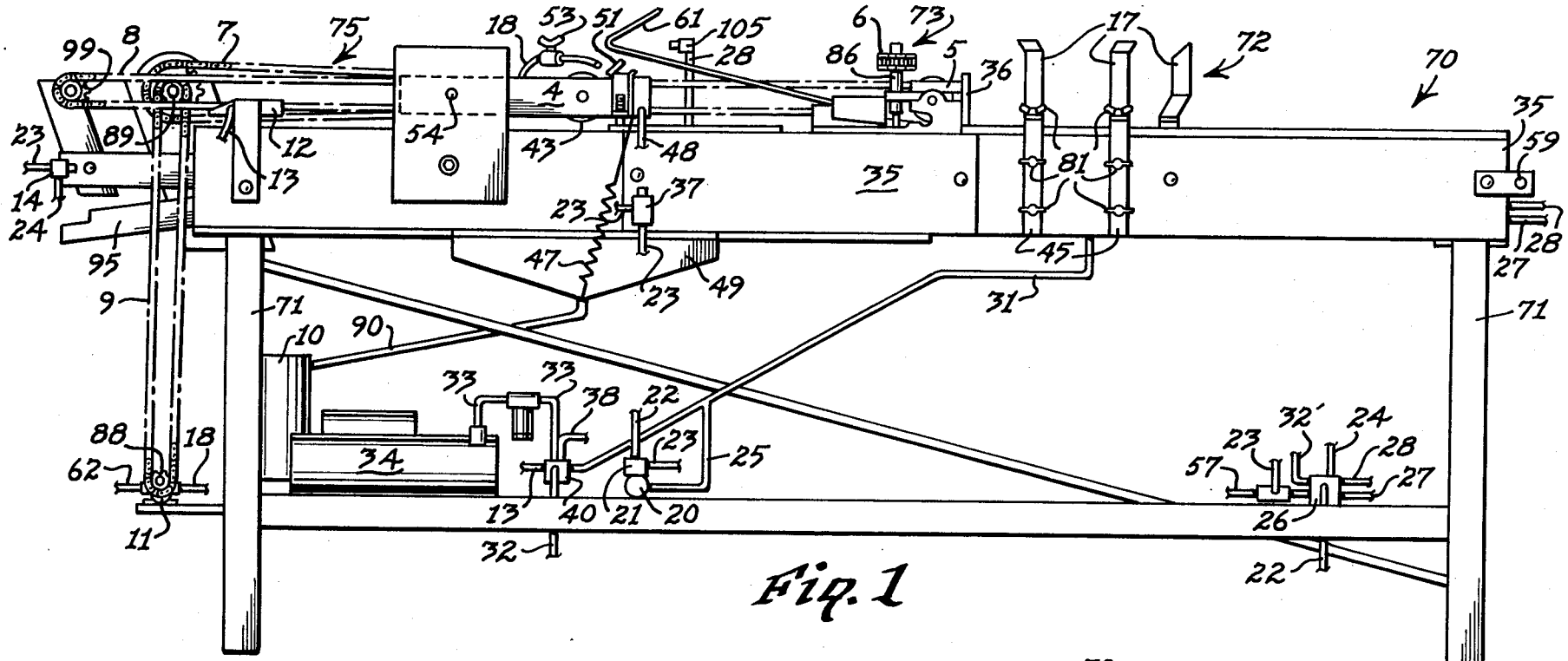
FIG. 1 is a front side elevational view of an apparatus made in accordance with this invention.

Referring now to the drawings in more detail, the apparatus 70, made in accordance with this invention, includes an elongated frame 35, disclosed in the drawings as being rectangular, and which may be supported upon upright standards or legs 71, or any other convenient suppporting means.

Disposed at longitudinally spaced intervals along the frame 35 are a feed station 72, a cutting station 73, a primer station 74 and a discharge station 75.

Adapted to be reciprocably moved longitudinally along the frame 35 from the feed station 72 to the discharge station 75 and back, is an elongated slide assembly or sole carriage 1 carrying a template or pattern member 2. As disclosed in FIG. 2, the sole carriage 1 has opposed side edges 76 longitudinally slideably received within opposed grooves 77 formed in the sides of the frame 35.

Figure 2:
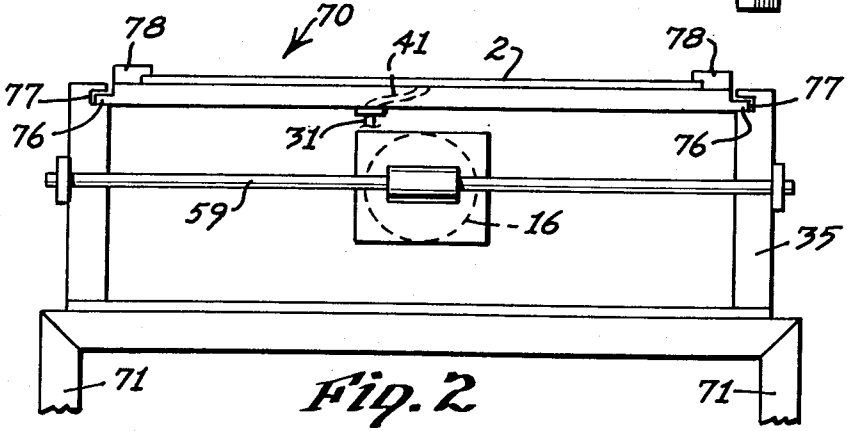
FIG. 2 is a right end elevational view of the apparatus disclosed in FIG. 1.
Figure 11:
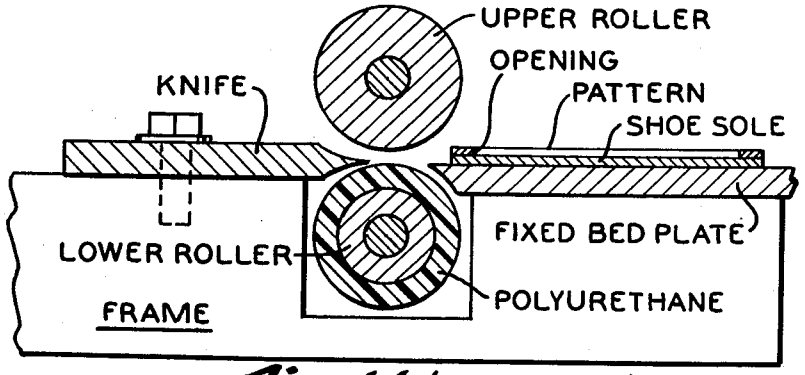
Fig. 11 (PRIOR ART)
FIG. 11 is a vertical longitudinal section of a prior art device for splitting shoe soles.
Figures 4, 8:
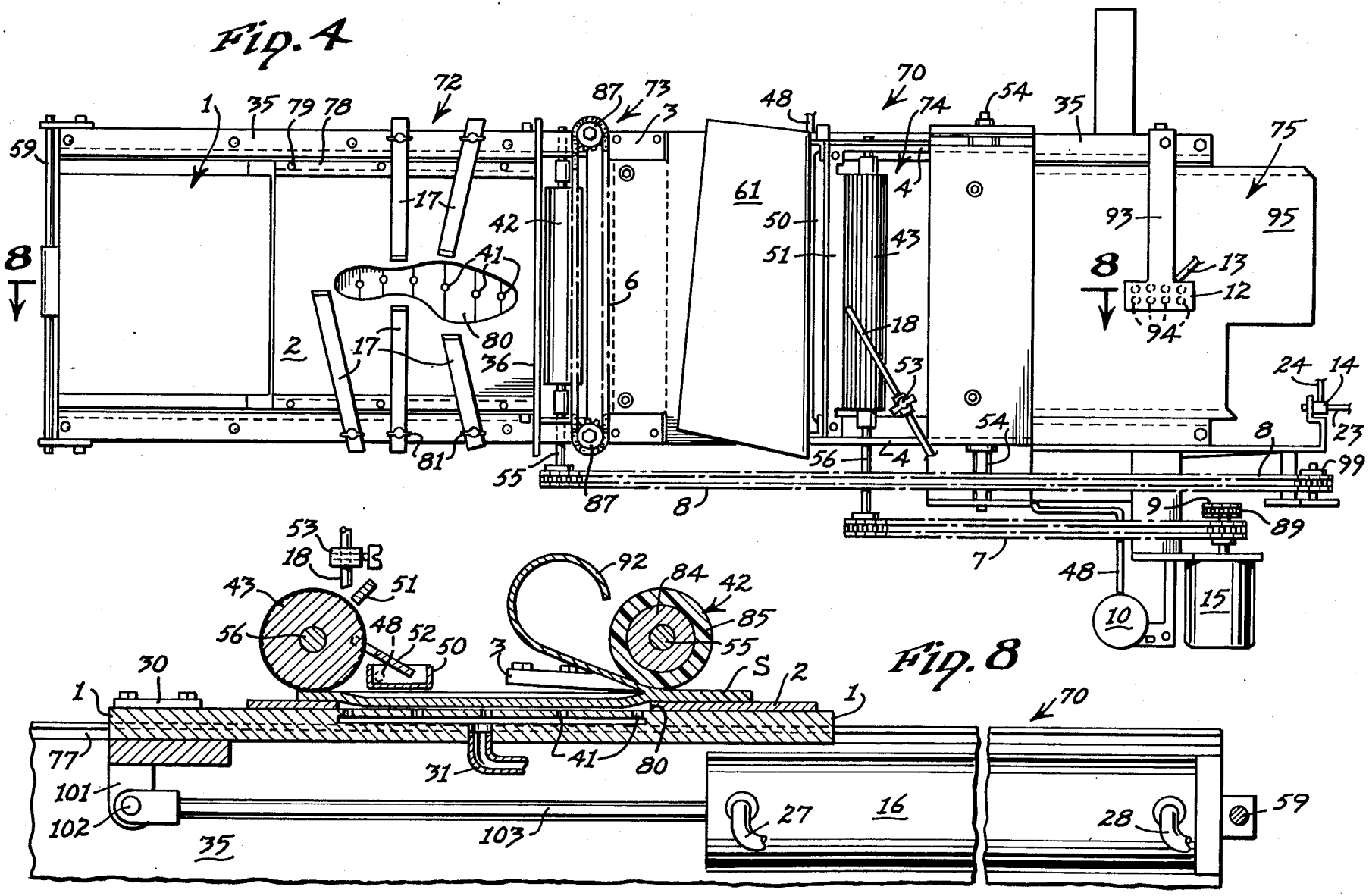
FIG. 4 is a top plan view of the apparatus disclosed in FIG. 3 with the sole carriage in its retracted or feeding position.
FIG. 8 is an enlarged section taken along the line 8—8 of FIG. 4, schematically illustrating the carriage in an intermediate position in which the trailing portion of a sole is being split and the leading split portion of the sole is being primed.

Fixed to the top of the carriage 1 are a pair of longitudinally extending opposed parallel flanged brackets 78 between which are slidably fitted an elongated pattern member or template 2 (FIGS. 2 and 4). The flanged brackets 78 may be detachably secured to the top surface of the carriage 1 by screw fasteners 79.

The template 2 includes an elongated opening or cavity 80 which has a marginal contour similar to, but of smaller size than, a shoe sole S to be processed by the apparatus 70.

The template 2 is interchangeable with other templates having different cavity sizes and shapes, depending upon the size and type of shoe sole to be processed. Each template 2 will have the same outer configuration, but will have a different configuration for each cavity 80.

Each shoe sole S will be placed upon the top surface of the template 2 and over the cavity 80, as illustrated by the dashed lines in FIG. 6, so that the entire continuous marginal portion of the sole S will rest upon the marginal surface of the top of the template 2 surrounding the cavity 80. Thus, the margin of the sole S will be supported by the template 2, while the major center portion of the sole S will span the opening or cavity 80.

A plurality of vacuum inlet holes 41 are formed to extend vertically through the carriage 1, so that each inlet hole 41 is in fluid communication with the cavity 80, as best illustated in FIGS. 2, 4, 5 and 8.

Figure 3:
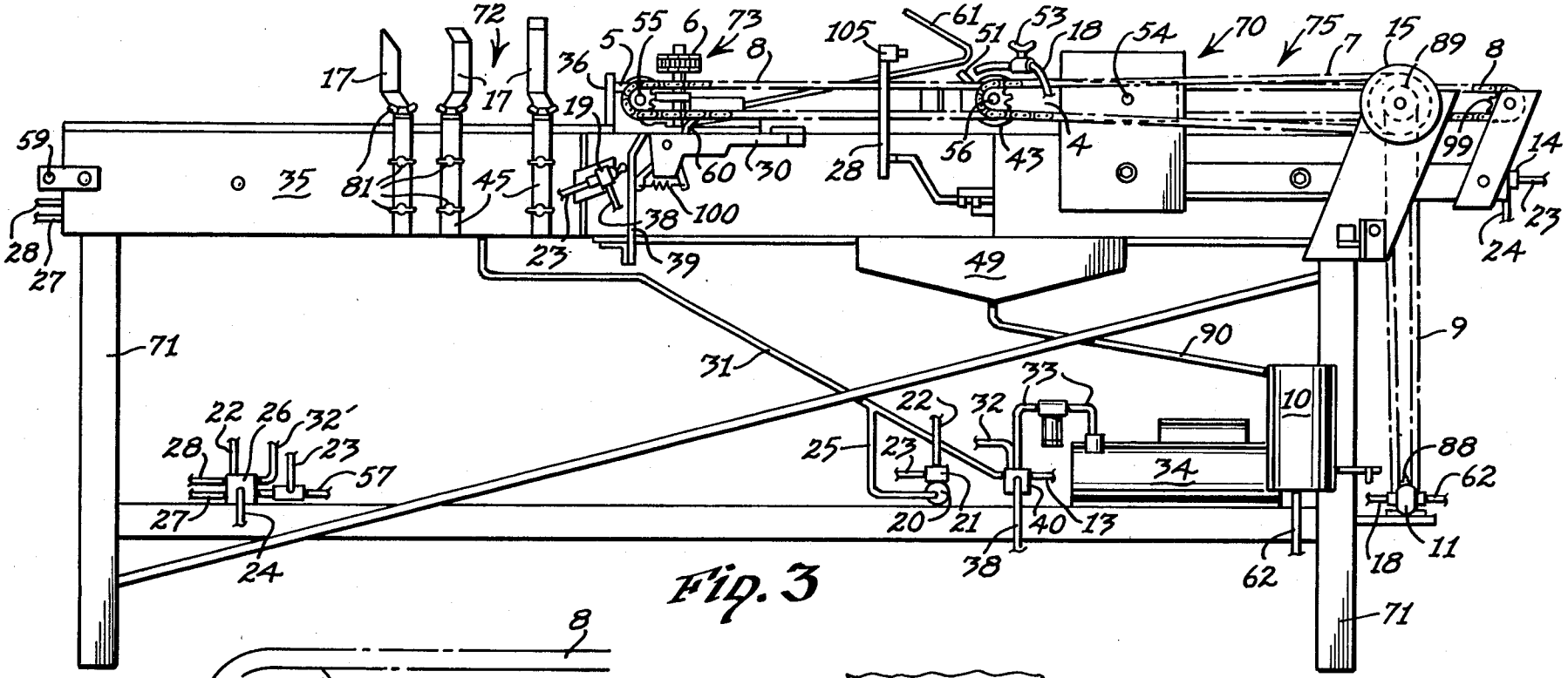
FIG. 3 is a rear side elevational view of the apparatus disclosed in FIG. 1.

If desired, a plurality of upstanding magazine or hopper standards 17 may be mounted in the feed station 72 and upon the frame 35 to support a stack of shoe soles S in the proper vertical feeding position over the cavity 80 when the template 2 is in its fully retracted feed position, as best disclosed in FIGS. 3 and 4. These magazine standards 17 may be adjustable both vertically, laterally, and longitudinally, relative to brackets 45, by adjustable fasteners, such as the wing nuts 81, in order to accommodate the stacks of different heights and soles S of different sizes and configurations.

An elongated transverse vertically disposed gate or bar 36 is fixedly mounted transversely of the frame 35 between the magazine standards 17 and the cutting station 73 to function as an end wall for the magazine defined by the standards 17, and to limit the passage of only one sole at a time beneath the gate 36 toward the cutting station 73.

In the cutting station 73, a horizontal knife or knife bar 3 having a beveled edge 82 is mounted transversely of the frame 35 for cutting the leading edge of the sole S as the carriage 2 moves the sole S against the beveled edge 82 of the knife 3.

The knife 3 is mounted on a vertically movable block 5, which also supports a transverse pressure roller 42 for cooperation with the knife 3. The pressure roller 42 may have a steel core 84 fixed to a transverse driven rotary shaft 55 and covered with an annular layer 85 of resilient material, such as polyurethane. The height of the pressure roller 42 and the knife 3 relative to the template 2 may be adjusted by rotating the chain 6 trained about corresponding sprockets 87 forming the upper ends of rotary adjustment screws 86. The adjustment screws 86 threadedly engage a portion of the mounting block 5 for vertical movement of the block 5 when the rotary adjustment screws 86 are turned.

The urethane pressure roller 42 is mounted above and slightly in advance of the beveled edge 82 of the knife 3 to exert downward pressure upon the shoe sole S as the sole S moves against the knife edge 82, as best disclosed in FIG. 8.

Rotatably mounted at the primer station 74 spaced behind or downstream of the pressure roller 42, is a primer roller 43 mounted on the rotary shaft 56 transversely of the frame 35. The primer roller shaft 56 is journaled in a frame 4 pivotally mounted about the pivot pins 54 on the frame 35 to permit slight pivotal movement of the primer roller 43 about the pivot pins 54. A spring 47 may be connected to the frame 4 and the frame 35 to bias the primer roller 43 downward to apply pressure upon the sole S as the sole S moves beneath the primer roller 43.

In a preferred form of the invention, the surface of the primer roller 43 is knurled to permit the surface of the roller 43 to carry more primer solution than a smooth roller. A primer solution or coating liquid is fed to the upper surface of the primer roller 43 through a feed conduit 18 in which the flow is controlled by a feed valve 43. The feed conduit 18 is supplied with the primer liquid from a primer pump 11 (FIG. 3) which in turn receives the primer liquid from primer tank 10 through supply conduit 62. The primer pump 11 may be a rotary type adapted to be driven by sprocket 88 connected through chain 9 to drive sprocket 89 connected through a gear transmission to a motor 15. The motor 15 also drives the primer roller 43 through a chain and sprocket transmission 7, in such a manner that the primer roller 43 is driven in a clockwise direction as viewed in FIGS. 1 and 8, or a counterclockwise direction as viewed in FIG. 3.

A transverse bar scraper 51 may be mounted transversely adjacent the surface of the primer roller 43 and below the discharge end of the feed tube 18, as best disclosed in FIG. 8, in order to control the level of primer solution transferred by the primer roller 43 to the surface of the sole S.

The recessed bar 52 may also be mounted transversely adjacent the surface of the primer roller 43 below the scraper bar 51 to remove excess liquid from the edges of the roller 43 and to permit the excess liquid to flow down the inclined bar 52 into the excess flow pan 50. A drainage conduit or tube 48 connects the pan 50 to the tank 10, as illustrated in FIGS. 4 and 5.

An over-flow pan 49 is also mounted beneath the primer station 74, as best illustrated in FIG. 3, and is connected by a drain conduit 90 to the primer tank 10, to permit re-use of the unused primer solution.

A diverter shield 61 may be mounted behind the cutting station 73 to divert the upper scrap portions 92 cut from the shoe sole S to prevent the scraps from entering the primer station 74, as best disclosed in FIGS. 1 and 3.

Fixedly mounted in the discharge station 75 is a pick-up suction head 12 supported by a transverse arm 93 fixed to the frame 35. The pick-up suction head 12 includes a plurality of air inlet apertures 94 (FIG. 4 and 5) in fluid communication with vacuum line 13. The suction head 12 is mounted about midway between the side edges of the frame 35 and above the path of the sole S when the carriage 2 moves into its extreme protracted discharge position, as best disclosed in FIG. 5. In this position, the suction head 12 is adapted to draw upward the sole S, and to remove the sole S from the carriage 2, when a vacuum is created within conduit 13 and the suction within the cavity 80 has been terminated. After the carriage 2 has been retracted and the suction removed from the suction head 12, the sole S drops upon an inclined discharge chute 95, for discharge by gravity from the discharge end of the apparatus 70.

In a preferred form of the invention, the pressure roller 42 is driven so that its surface moves in the same longitudinal direction and at the same velocity as the carriage 1 during its advancing protracted movement. During the retracted movement of the carriage 1, the pressure roller 42 is idle.

Figure 10:
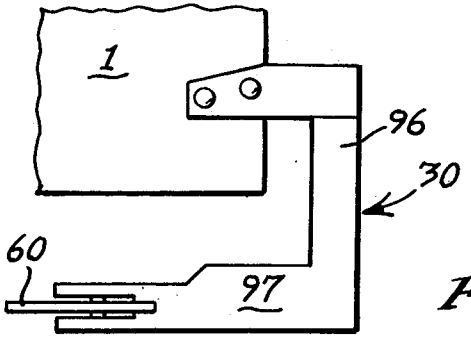
FIG. 10 is a fragmentary top plan view of the drive mechanism disclosed in FIG. 9.
Figure 9:
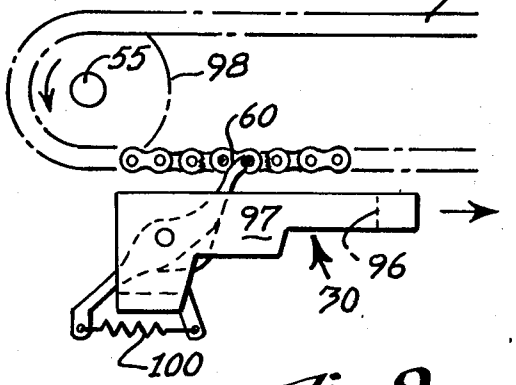
FIG. 9 is an enlarged, fragmentary, rear elevational view of the drive mechanism for driving the pressure roller.

In order to drive the pressure roller 42, a drive member 30 is fixed to the leading end of the slide or carriage 1, as best disclosed in FIGS. 5, 8 and 10. The drive member 30 includes a transverse connecting arm 96 integrally connected to a pawl carriage 97 pivotally supporting a pawl 60 for swinging movement in a longitudinal vertical plane. The upper end of the pawl 60 is adapted to engage the lower run of the endless chain 8, trained about a sprocket 98 fixed to the rear end of the pressure roller shaft 55. The chain 8 is also trained about an idler sprocket 99 fixedly mounted adjacent the discharge end of the frame 35. The weighted lower end of the pawl 60 causes the upper end to engage the chain 8 when the carriage is protracting, but permits the upper end of the pawl 60 to ride or ratchet over the lower run of the chain 8 when the carriage is moving in the opposite, retract, direction. If desired, the pawl 60 may be biased toward its engaging position with the chain 8 by means of a spring 100 (FIG. 9), connected to the lower end of the pawl 60.

In order to reciprocably move the slide or carriage 1 longitudinally of the frame 35, a depending racket 101 fixed to the front end of the slide 1 is connected by clevis pin 102 to piston rod 103 reciprocably driven by the pneumatic cylinder 16. The rear end of the pneumatic cylinder 16 is pivotally connected by pin 59 to the right end of the frame 35 as viewed in FIG. 8. A fluid conduit 28 is connected to the right end of the cylinder 16 so than when compressed air is introduced through the conduit 28, the piston rod 103 will protract, whereas, when fluid or compressed air is introduced into the cylinder 16 through the conduit 27 at the opposite end, the piston rod 103 will retract.

The fluid lines 27 and 28 are connected to a conventional air spool valve 26 having pilot lines 22 and 24 through which air may selectively flow to shift the spool valve 26 between protract and reverse modes. The air spool valve 26 is also in fluid communication with a discharge connection 32' and an air supply fixture including an air supply line 57 and an auxiliary air supply conduit 23. The main air supply inlet line 57 may be connected to an existing source of compressed air, such as in air compressor, not shown.

At opposite end of the frame 35, as disclosed in FIGS. 1 and 3, a vacuum pump 34 is connected through a fluid line 33 to a conventional vacuum spool valve 40 having at its opposite ends respective pilot lines 32 and 38. The pilot line 32 is connected to air discharge connection 32' in air spool valve 26. The vacuum spool valve 40 includes ports for diverting the flow of air selectively through lines 31 and 13. A conventional valve actuator 20 having a fluid line 25 tee-connected to line 31 is operatively connected to an air pilot valve 21 connected between auxiliary air supply conduit 23 and the pilot line 22 to air spool valve 26.

Mounted on the discharge end of the frame 35 is an air reversing valve 14 (FIG. 4) connected between auxiliary air supply conduit 23 and the air spool valve pilot line 24. The air reversing valve 14 is adapted, when engaged by the leading edge or other portion, of the carriage 1 in its extreme protracted position, to open air flow through the valve 14 and pilot line 24 to shift the air spool valve 26 to cause the pneumatic cylinder 16 to reverse its mode from protract to retract.

Mounted along the rear side of the frame 35 is a protract reversing valve 19 connected between auxiliary air supply conduit 23 and vacuum pilot line 38. The protract reversing valve 19 is actuated by engagement with an actuator arm 39 carried by the drive member 30. Thus, when the carriage 1 is retracted to its extreme feed position, the arm 39 actuates the protract valve 19 to supply air through the pilot line 38 to shift the vacuum spool valve 40 to its protract mode to re-actuate the valve 21 to shift the air spool valve 26 to its protract mode when a sole S is in feed position over the template cavity 80, and also to shift the vacuum from line 13 to line 31.

The manual control valve 37 may be used to stop the carriage 1 in the discharge station 75, when the apparatus 70 is in its automatic mode, that is when a sole S is seated over the template cavity 80, since closing the air supply line 23 to the valve 14 will prevent air from flowing through pilot line 24 to air spool valve 26.

In the protract position, as illustrated in FIG. 5, a template 2 may be removed by manually rotating the cam lock 29 to disengage the leading edge of the template 2 to permit replacement of the template 2. The cam lock 29 is schematically shown since any desired type of lock or retainer mechanism may be employed.

In the operation of the apparatus 70, the carriage 1 will be in its extreme retracted position, as illustrated in FIG. 4, with the template 2 in its feed position for receiving one or more soles S between the magazine standards 17 and located centrally over the cavity 80, so that the marginal edge portion of the sole S will be supported by the marginal area of the template 2 surrounding the cavity 8. The system is supplied with air through the main supply line 57, and the vacuum pump 34 is energized.

As soon as a sole S is placed over the cavity 80, the inlet air passage to the vacuum pump 34, through the ports 41, conduit 31, spool valve 40, and inlet line 33, is immediately sealed to create a vacuum within the cavity 80. The suction within the cavity 80 is great enough to depress or pull down the central position of the sole S partially into the cavity 80 and also to hold the sole S in position as it is moved by the carriage 1 through the various stations to its extreme discharge position at the station 75. The high vacuum created within the cavity 80 is transmitted through the lines 31 and 25 to the vacuum actuator 20, triggering air pilot valve 21 to cause a flow of air through the pilot line 22 to shift the air spool valve 26 to its protract mode and to cause air to flow through the line 28 within the cylinder 16 to protract the piston rod 103 and carriage 1. The protracted movement of the carriage 1 simultaneously drives the pressure roller 43 at the same linear speed as the carriage 1, through the drive member 30 and chain transmission 8, as previously described.

The shoe sole S is carried by the carriage 1 beneath the magazine gate 36, and beneath the urethane roller 42 into engagement with the blade 3. The urethane roller 42 exerts further pressure on the top surface of the shoe sole S, and assists in forcing the central portion of the sole S down into the cavity 80. Moreover, the resilient urethane material 85 on the pressure roller 42 firmly grips the sole S to hold it in its stationary position relative to the carriage 1. By virtue of the central portion of the sole S being depressed into the cavity 80, the beveled edge 82 of the knife 3 cuts the upper portion of the sole S, only along the marginal edge portion of the sole S, without cutting the central portion. As the sole S is cut or split, the upper scrap portion 92 is diverted upwardly, not only by the knife 3, but also by the scrap diverter plate or shield 61.

The split or cut portion of the sole S continues to travel with the carriage 1 until the leading edge of the sole S moves beneath the primer roller 43. Because the central portion of the sole S is still depressed within the cavity 80 by the high vacuum beneath the sole S, the primer roller 43 only engages and applies primer solution or coating to the cut or skived marginal edges of the sole S. The pressure of the primer roller 43 is maintained against the marginal edges of the sole S by its own weight and also by the spring 47 (FIG. 1), pulling the pivotal frame 4 downward.

The cut and primed sole S then moves from the primer station 74 into the discharge station 75 until the carriage 1 reaches its extreme protracted or discharge position. In the extreme protracted position, a leading portion of the carriage 1 engages the reversing valve 14 to open the flow of fluid from the air supply line 23 to the air pilot line 24, causing the air spool valve 26 to shift to its reverse mode diverting the flow of compressed air into the line 27 and discharging the line 28, thereby causing the retraction of the piston rod 103 and the carriage 1.

Simultaneously with the reversal of mode of the air spool valve 26, air is discharged through the pilot line 32'–32 to shift the vacuum spool valve 40 to its reverse mode, to create a positive air flow through the line 31 and into the cavity 80 to blow or force upward the sole S. Also simultaneously, vacuum is created in the line 13 which is connected to the pick-up suction head 12 to pull upward the trimmed and primed sole S from the template 2 to hold the sole S in the discharge station 75 while the carriage 1 retracts to its original feed position in the feed station 72.

As previously described, as the carriage 1 approaches its original and extreme retracted position, the arm 39 engages the protract reversing valve 19 to reverse the mode of the vacuum spool valve 40. Simultaneously, the vacuum in line 13 is removed to permit the pick-up head 12 to release the processed sole S to drop upon and slide down the discharge chute 95, and the vacuum line 31 is re-opened to repeat the sole splitting-priming cycle when a sole S is in place over the template cavity 80.

If there is a sole S located in the feed station 72 to seat upon and cover the cavity 80 of the template 2 in its fully retracted position, the air spool valve 26 is shifted to its protract mode to actuate the cylinder 16 to again automatically protract and repeat the cycle. The cycles are repeated automatically as often as there is a sole S in the feed station 72.

It will be understood that other types of controls than the specific pneumatic control elements disclosed in the drawings may be utilized to carry out the above-described functions, so long as the carriage 1 may be reciprocably moved between the feed station 72 and the discharge station 75 and a vacuum is maintained within the covered cavity 80 during the protract movement of the carriage 1 from the feed station 72 to the discharge station 75.

When the air spool valve 26 is shifted to its "retract" mode, air discharged through the line 28 is carried to a scrap blowing device 105 to blow the scrap material 92 transversely from the scrap diverter shield 61.

It is therefore seen that an apparatus 70 has been designed which is fully automatic for not only holding and trimming only the marginal edge portions of a shoe sole, but also for applying primer solution to only the cut marginal edges of the sole.

Moreover, the apparatus 70 is designed for automatically cutting or splitting and priming the marginal edges of shoe soles of various sizes and designs by merely and quickly interchanging templates having various patterned configurations.

What is claimed is:

1. An apparatus for treating the marginal edge portion of a shoe sole comprising:

(a) a sole treating station having a front and a rear, (b) a roller, (c) means journaling said roller for rotation about a rotary axis extending transversely of said treating station, (d) a sole carriage having a longitudinal axis, (e) an elongated template on said sole carriage having a top surface and an opening therethrough, (f) said opening having a profile similar to the marignal edge portion of a shoe sole to be treated, but of smaller size than the shoe sole, so that the shoe sole may be placed flush against said top surface completely covering said opening and overlapping said top surface, and the continuous marginal edge portion of the shoe sole to be treated will be supported by said top surface and the central portion of the sole will span said opening, (g) means for creating a vacuum within said opening when covered by the sole, to draw the central portion of the sole spanning said opening down into said opening while the marginal edge portion of the shoe sole lies against said template in an operative position, (h) a feed station in front of said sole treating station, (i) a discharge station behind said sole treating station, (j) carriage drive means for moving said carriage longitudinally from said feed station through said sole treating station to said discharge station, and means for reversing said drive means to return said carriage to said feed station, (k) control means for controlling said means for creating a vacuum within said opening, so that a vacuum is created within said opening while a shoe sole covers said opening and said carriage is moving from said feed station to said discharge station, and means for releasing said vacuum at said discharge station for removal of the treated sole, (l) treating means in cooperation with said roller for treating only the marginal portion of the sole when said carriage supporting the central portion of a sole in said opening moves through said treating station, (m) said journaling means supporting said roller at an elevation at which said roller engages the top of the sole and said treating means treats the top portion of the marginal portion of the sole at a predetermined height above said template and clears the central portion of the sole drawn down into said opening, (n) roller drive means for rotating said roller in the same direction as the longitudinal direction of movement of said carriage from said feed station to said discharge station, and while said carriage is moving from said feed station to said discharge station.

2. The invention according to claim 1 further comprising means for de-actuating said means for driving said roller while said carriage returns to said feed station.

3. The invention according to claim 2 in which said roller drive means for rotating said roller comprises a sprocket fixed co-axially of said roller, an endless chain trained about said sprocket and extending longitudinally of said apparatus, a drive bracket fixed to said carriage, a pawl pivotally mounted on said drive bracket, said pawl being adapted to engage said chain to move said chain as said carriage moves from said feed station to said discharge station, and said pawl being adapted to disengage said chain as said carriage returns to said feed station.

4. The invention according to claim 1 in which said sole treating station comprises a sole cutting station, said treating means comprises a knife member having a cutting edge extending transversely of said cutting station, projecting forward, and transversely spanning the entire width of a sole carried by said sole carriage in said operative position, said roller being spaced in front of and substantially parallel to said cutting edge, said carriage drive means being operable to move said carriage longitudinally through said cutting station and beneath said roller and said knife member at an elevation in which said cutting edge cuts the top portion of the marginal portion of the sole in said operative position at said predetermined height above said template, said cutting edge clearing the central portion of the sole drawn down into said opening.

5. The invention according to claim 4 further comprising means for adjustably mounting said knife member to adjust the elevation of said cutting edge relative to said template.

6. The invention according to claim 4 in which said roller is made of a semi-resilient material sufficient to roll over the top surface of the shoe sole, yet firmly holding the shoe sole against said template and said carriage while the marginal edge portion of the shoe sole is being cut, and to depress the central portion of the sole into said opening.

7. The invention according to claim 6 in which said semi-resilient material is a polyurethane material.

8. The invention according to claim 4 further comprising a primer station between said sole cutting station and said discharge station, and means for applying an adhesive primer coating to the cut marginal edge portion of the sole as said carriage moves through said primer station.

9. The invention according to claim 8 in which said means for applying a primer coating to the sole comprises a primer roller mounted for rotary movement about a transverse axis, said primer roller being adapted to roll over the top surface of the cut marginal edge portion of the sole as said carriage moves beneath said primer roller, and means for supplying an adhesive primer solution to the surface of said primer roller.

10. The invention according to claim 1 in which said sole treating station comprises a sole primer station, said treating means comprising means for supplying a primer coating to said roller, said carriage drive means being adapted to move said carriage longitudinally through said primer station and beneath said roller at an elevation in which said roller engages the top of the sole and said roller applies primer coating only to the top portion of the marginal portion of the sole in said operative position at a predetermined height above said template, said roller clearing the central portion of the sole drawn down into said opening.

11. The invention according to claim 1 further comprising a magazine supporting a stack of soles at said feed station for positioning the bottom sole of said stack upon said template spanning said opening, when said template is in said feed station.

12. The invention according to claim 1 further comprising a suction head at said discharge station spaced above said template while in said discharge station, said control means comprising means for blowing air from said opening to force the sole in said discharge station upward against said suction head, and means for creating a suction in said suction head to hold the sole while said carriage returns to said feed station.

13. The invention according to claim 12 further comprising means for removing the vacuum in said suction head after said carriage has returned to said feed station, to release the cut sole in said discharge station.

* * * * *